US005782553A

United States Patent [19]

McDermott

[11] Patent Number: 5,782,553

[45] Date of Patent: Jul. 21, 1998

[54] MULTIPLE LAMP LIGHTING DEVICE

[76] Inventor: Kevin McDermott, 196 Phillips Dr., Hampstead, Md. 21074

[21] Appl. No.: 144,653

[22] Filed: Oct. 28, 1993

[51] Int. Cl.[6] ..... F21V 5/00

[52] U.S. Cl. ..... 362/245; 362/247; 362/308; 362/310; 362/327; 362/329; 362/363; 362/800

[58] Field of Search ..... 362/235–237, 362/241, 244, 245, 247, 249, 252, 307, 308, 310, 327, 328, 329, 363, 800

[56] References Cited

U.S. PATENT DOCUMENTS

| | | | |
|---|---|---|---|
| 1,214,309 | 1/1917 | Jillson, Jr. et al. | 362/347 |
| 1,365,027 | 1/1921 | Farrar | 362/247 |
| 1,699,692 | 1/1929 | Ecker | 362/307 |
| 4,271,408 | 6/1981 | Teshima | 362/800 |
| 4,654,629 | 3/1987 | Bezos | 362/800 |
| 4,698,730 | 10/1987 | Sakai et al. | 362/800 |
| 5,136,483 | 8/1992 | Schoniger et al. | 362/800 |

*Primary Examiner*—Alan Cariaso

[57] ABSTRACT

An electric lighting device that uses a concave reflector to collect and concentrate the light emitted by a plurality of luminescent light sources. The cooperating relationship between the orientation of the light sources and contour of the reflector increases the parallelism of the light beams projected from the device so that they can combine to form a composite beam. The spatial relationship between the light sources and the inclusion of a light transmitting medium reduce overheating and increase the efficiency of the device.

28 Claims, 8 Drawing Sheets

MULTIPLE LAMP LIGHTING DEVICE

BACKGROUND OF THE INVENTION

1. Field of the Invention

This invention relates to a lighting device which uses a plurality of light emitting diode lamps in combination with a concave reflector to produce a concentrated composite output light beam.

2. Related Prior Art

Light emitting diode or LED lamps have been considered for many lighting devices because of their long life, high luminous efficiency and intrinsic colors. However, their use has been limited to low intensity devices because individually they emit only small quantities of light energy and it has not been possible to efficiently combine a plurality of LED lamps into a single lighting device of limited size capable of emitting a concentrated light beam meeting specific intensity, beam spread, power consumption and size requirements.

If two or more separate LED light sources are used with a single parabola as a means to increase intensity then the lighting device would project multiple separate beams with dark intermediate zones. This would not be acceptable. One potential solution to this problem would be to use a light diffuser to increase the individual divergence of each beam to cause them to overlap. This solution is usually not acceptable because it reduces the intensity of the composite beam below acceptable levels.

A second potential solution includes the use of multiple reflectors requiring one for each LED lamp. This solution is not acceptable because the overall size limitation for the lighting device forces each individual reflector to be reduced in size resulting in projected beams with unacceptably large individual divergences.

If a concave reflector is used to collect the light from LED lamps, the salient characteristics of the luminescent element and the housing contour create problems. Unlike incandescent lamps which radiate their light into the surrounding hemisphere with relatively equal intensity in all directions, LED lamps with their substantially planer luminescent elements radiate high intensity light in the forward direction with a substantial gradient resulting in only minimal quantities of light energy radiated to the sides. The parabola which normally collects light from the sides of an incandescent lamp has little side light energy to collect from LED lamps. Therefore, the LED cannot be positioned in a parabola as if it were an incandescent lamp with the expectation of achieving the high light collecting efficiency associated with an incandescent lamp. Designs which seek to use the LED efficiently must place their reflectors in an appropriate relationship to the directional spatial radiation pattern of the light emitted by the LED. Furthermore, steps must be taken to assure that the size and location of the luminescent element does not appear distorted to the reflector as a single larger source or as a plurality of light sources. The apparent enlargement of the luminescent element would create problems for almost all optical devices. For example, a small point source of light when placed at the focal point of a parabolic reflector creates a concentrated spot beam with parallel rays. If the source is made to appear larger a less intense projected beam with an unacceptably large divergence is created.

SUMMARY OF THE INVENTION

It is, therefore, an objective of the present invention to create a compact lighting device with a limited size exit aperture to project a high intensity concentrated output beam with light efficiently collected by a single concave reflector from multiple luminescent elements or LED lamps.

It is an additional objective to orient the directionally sensitive spatial radiation pattern of a plurality of luminescent light sources relative to the axis and focal point of the reflector to increase the output of a lighting device with limited frontal area.

Another objective of this invention is to use a light transmitting medium between the light sources and reflector to minimize variations in the indicies of refraction which create distortion or enlargement of the light source.

Another objective is to select a light transmitting medium with high transmissivity considering both the wavelengths of the light and the thicknesses through which the light must pass to avoid attenuation which could easily exceed and offset improvements in efficacy associated with the use of the transparent medium.

Another objective of this invention is to create an electronic lighting device which is less prone to overheating because the thermal energy created by its luminescent light sources is efficiently transferred to its exterior where it can be constructively used to melt snow which would obscure the exit aperture during winter.

Another objective of this invention is to use a plurality of LED lamps with a single reflector to create a composite light beam of a specified intensity and beamwidth.

Another objective of this invention is to design the contour of the reflector to reduce the between beam divergence which results from the spacing between multiple light sources.

Another objective is to use a refracting lens to reduce the between beam divergence which results from the spacing between multiple light sources.

Although limited embodiments of the present invention have been described above, the scope of the present invention is not limited thereto. Various combinations of the respective constituent elements, modifications and alterations thereof will be apparent to those skilled in the art.

In accordance with the above described and other objectives, the present invention provides a lighting device including light emitting diode lamps or luminescent elements interacting with a concave primary mirrored reflector cooperatively positioned and proportionally dimensioned to create a high efficiency lighting device with a uniformly lighted face. The frontal projected area of the lighting device is kept within the limited requirements for each particular use, while simultaneously producing more concentrated light output than previously available with luminescent light sources. By encapsulating the light sources in a transparent medium distortion of the size and location of the light emitting element is avoided preventing a reduction in the intensity of the reflected light. To minimize attenuation, as the light moves back and forth, special transparent mediums which maintain high light transmission in thick sections at the wavelengths of the light being transmitted are used. Attenuation is further minimized by placing the LED lamps a distance from the focal point of the reflector in the direction which reduces the distance through which the light must travel. A hyperbolic reflector is employed to reduce unacceptable between beam divergence which would normally result from this off-focus lamp location.

Some configurations emit multiple individual light beams which are slightly diverging and directionally controlled to combine at a specified distance exterior to the lighting device to form a composite beam with a defined shape and intensity pattern.

Additional improvements in the invention are achieved by the proper rotational and angular positioning of each LED relative to the axis of the primary reflector employing the inherent directional characteristics of the spatial radiation pattern of the luminescent elements to cooperate with the contour of the reflector and a light refracting lens to create a projected beam meeting a specification shape and intensity.

BRIEF DESCRIPTION OF THE DRAWINGS

Other objects, features, and advantages of the present invention will become more apparent from the following detailed description of preferred embodiments and certain modifications thereof when taken together with the accompanying drawings in which.

DETAILED DESCRIPTION OF THE PREFERRED EMBODIMENTS

Figure 1:
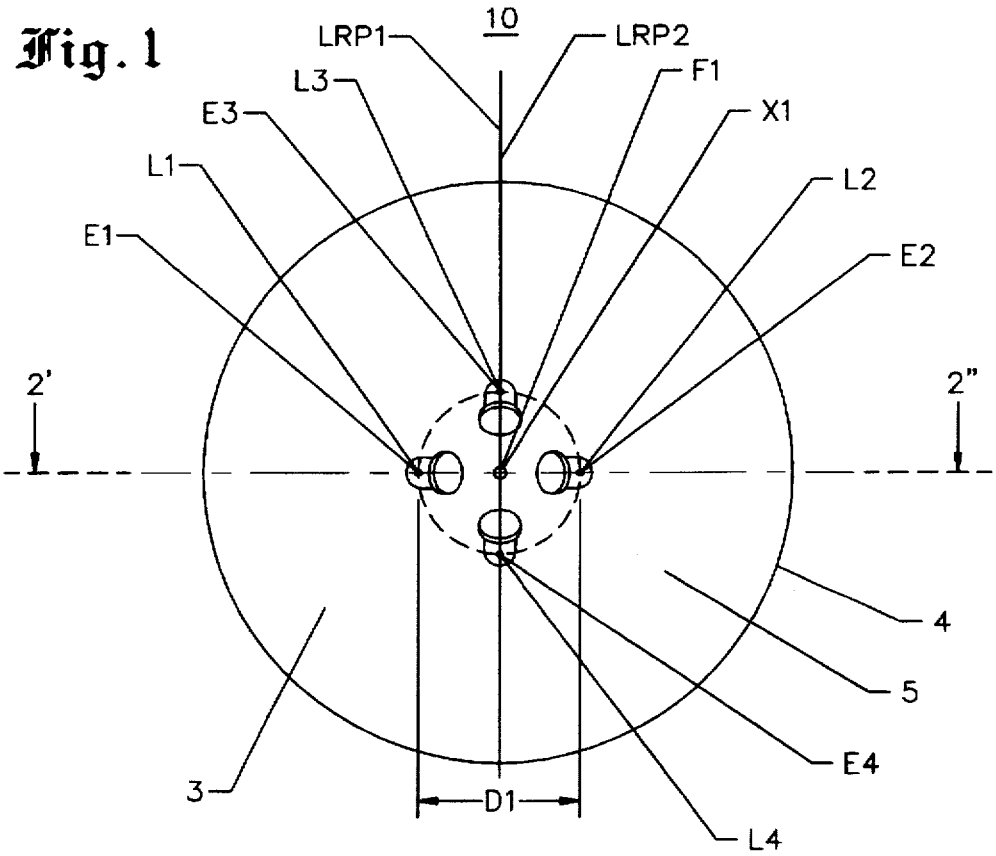
FIG. 1 is a front view of a lighting assembly including a parabolic reflector, a plurality of LED lamps and a refracting lens.
Figure 2:
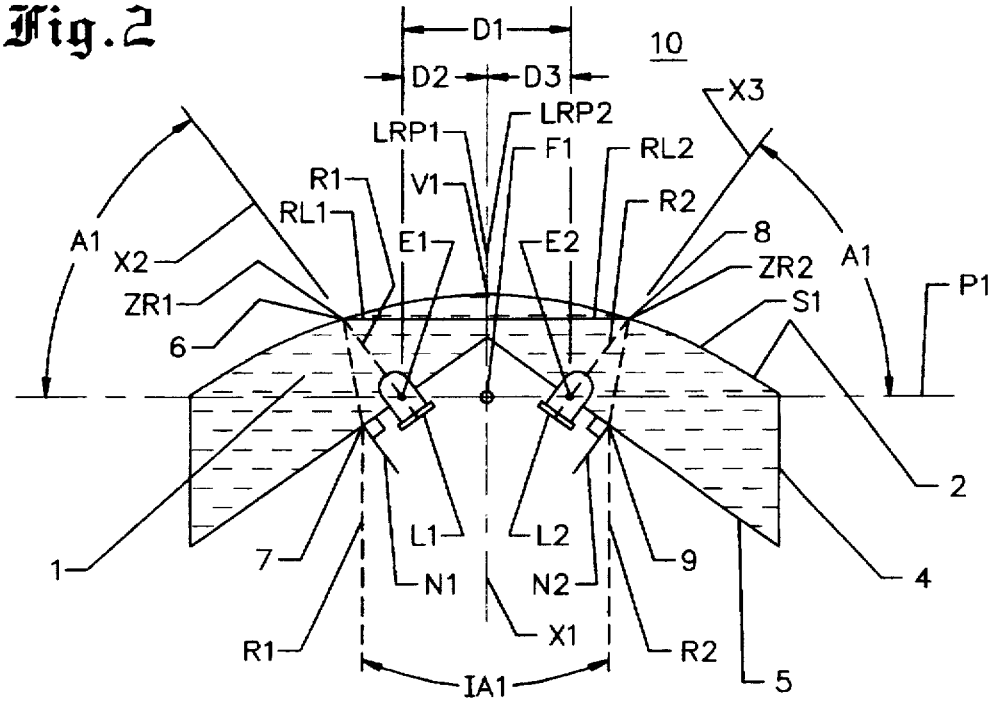
FIG. 2 is a diagrammatic cross-sectional view through line 2'—2" of the FIG. 1 assembly.

FIGS. 1 and 2 are front and diagrammatic cross-sectional views of lighting assembly 10 which includes solid transparent medium 1 molded with a parabolic rear contour 2 and cone shaped lens 3. Lens 3 has side 4 and refracting surface 5. Parabolic rear contour 2 developed about focal point F1 and axis of revolution X1 with focal plane P1 passing through focal point F1 is coated with a reflective coating forming reflector S1. LED lamps L1, L2, L3 and L4 are positioned with their luminescent elements E1, E2, E3 and E4 equally spaced on a circle centered at focal point F1 on a diametrical distance D1 and also on focal plane P1. They are partially encapsulated in transparent medium 1. The cross-sectional FIG. 2 drawing shows typical LED lamps L1 and L2 held so that their geometrical housing axes X2 and X3, each intersect focal plane P1 at included angle A1. Light ray R1 emitted from LED lamp L1 along axis X2 is redirected at point 6 by reflector S1. Since luminescent element E1 is at a distance D2 from focal point F1 on focal plane P1 reflected ray R1 will immediately after reflection converge towards axis of revolution X1. However, upon exiting lens 3 at point 7 on surface 5, Ray R1 will be refracted relative to reference normal N1 so that it emerges parallel to axis of revolution X1. Ray R2 from LED lamp L2 with luminescent element E2 located at a distance D3—usually equal to distance D2—from focal point F1 on focal plane P1 is similarly refracted at point 8 relative to reference normal N2 so that it emerges at point 9 also parallel to axis X1. A similar situation occurs for other rays from each of the four LED lamps creating a composite intense output light beam. Reflector S1 lies on the vertex V1 side of focal plane P1. Reference line RL1 is perpendicular to axis of revolution X1 and coincident with point of intersection 6. Location reference plane LRP1 is coincident with axis of revolution X1 and normal to reference line RL1. Reference line RL2 is perpendicular to axis of revolution X1 and coincident with point of intersection 8. Location reference plane LRP2 is coincident with axis of revolution X1 and normal to reference RL2. Point of intersection 6 is at reflective zone ZR1 and point of intersection 8 is at reflective zone ZR2. Light source L1 and reflective zone ZR1 are located on the same side of location reference plane LRP1. Light source L2 and reflective zone ZR2 are located on the same side of location reference plane LRP2. Light ray R1 and light ray R2 will eventually intersect to form included angle IA1.

Selection of transparent medium 1 from a large variety of transparent materials is a critical aspect of this device as a light ray can pass through a cumulative thickness of one inch or more as it proceeds from the luminescent element to the primary reflector and finally exit through a refracting surface. If a solid transparent medium is used it will frequently be an epoxy or plastic resin. Polycarbonate plastic in General Electric (registered Trademark) clear color #112 is commonly used for optical lenses and reflectors. However, this resin would be inferior if used with the current invention because as its thickness increases from ⅛ to 1.0 inch its light transmission drops from 88% to 66% seriously degrading the efficacy. Selection of clear color number 111N from General Electric (registered Trademark) would be a superior choice because its light transmission only decreases to 85% as the thickness increases to 1.0 inch and therefore, it maintains an acceptable overall efficacy for the lighting device. Some grades of acrylic are excellent when using visible light because the transmission remains above 85 percent even through thicknesses of several inches. Conversely, in the infrared wavelengths of light, acrylic can be a poor choice as it can absorb excessive amounts of light energy. Consequently, it is critical that the grades and colors of the plastic be chosen with due attention to the wavelength of the light being transmitted as a proper choice for one wavelength may be poor for another. A transmissivity of at least 75 percent through a 1.0 inch thickness has been found acceptable.

The use of a solid transparent medium permits a highly efficient design because the medium can be contoured to form the lens and reflector. Eliminating multiple components increases the efficacy of the lighting device for two reasons. Firstly, the spectral transmission curve differs from material to material even when all are identified as clear. In fact the curve differs between batches of the same material. Thus a light beam with a given spectral radiation will experience a first attenuation related to its color as it passes through a first material and then a second attenuation also related to its color as it passes through a second material. Since the attenuation by each material is based on a different relationship to the emitted color, the total transmission is less than would be experienced by a single material of equal cumulative thickness. Secondly, even if the identical material were used in layers or plates there would be losses at the interface between plates which would be avoided by a design incorporating a single plate of the same cumulative thickness.

Including a transparent medium in the design provides additional benefits. The transparent medium provides higher thermal conductivity than ambient air and permits heat generated by the lamp to easily pass to the exterior of the device where it can be used to melt ice or snow. Simultaneously, this lowers the lamps internal temperatures permitting them to operate at higher currents and generate more light.

Figure 3:
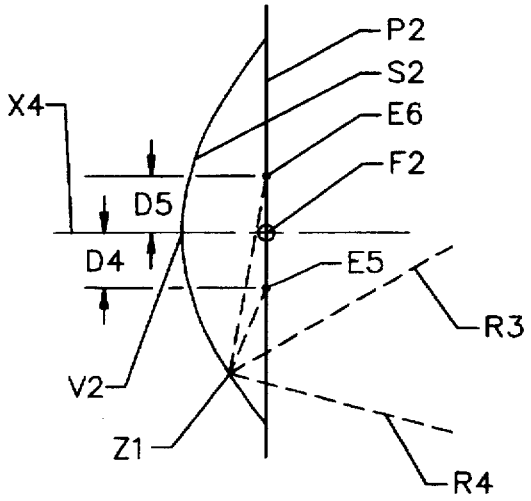
Fig. 3 (PRIOR ART)
FIG. 3 is a diagrammatic view of an assembly including a parabolic reflector and two luminescent light sources.
Figure 4:
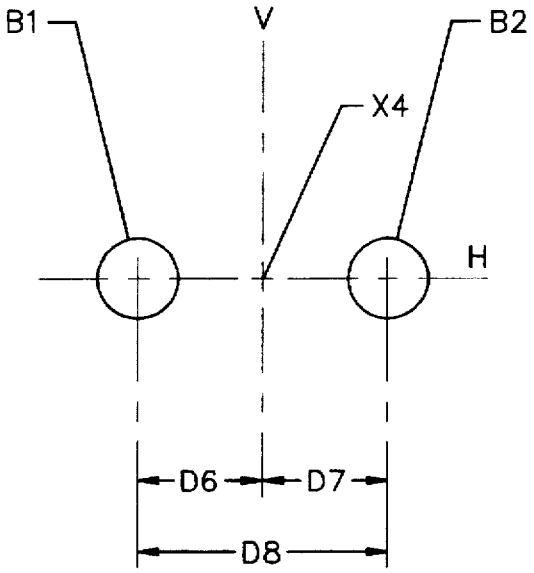
Fig. 4 (PRIOR ART)
FIG. 4 is the projected beam pattern from the FIG. 3 assembly.

FIG. 3 is a diagrammatic view of a prior art parabolic reflector S2 having axis of revolution X4 coliniar with the line of intersection of the horizontal H and vertical V planes, focal point F2, vertex V2 and focal plane P2. FIG. 4 is the projected beam pattern created by the FIG. 2 device. Luminescent element E5 which is laterally located a distance D4 from focal point F2 emits typical light ray R3 towards zone Z1 of reflector S2 where it is reflected. Subsequently, reflected ray R3 immediately converges then finally diverges from axis X4 contributing projected beam pattern B1 of FIG. 4. Luminescent element E6 which is located at distance D5 from focal point F2 emits typical light ray P4 towards zone Z1 of reflector S2 where it is reflected. Reflected ray R4 immediately diverges from axis X4 contributing to projected beam pattern B2 of FIG. 4. In the horizontal plane H beam B1 will be at a distance D6 to the left of the vertical plane V and beam B2 will be at a distance D7 to the right of the vertical plane V. Distance D6 is proportional to distance D4 and distance D7 Is proportional to distance D5. Distance D8 is the sum of D6 and D7 and proportional to the final between beam divergence. It is necessary to minimize distance D8 so that each luminescent element creates a projected beam pattern in close proximity to other projected beam patterns so that all can contribute to the final composite beam pattern.

Referring back to FIG. 2, it can be seen that luminescent elements E1 and E2 direct their typical light rays R1 and R2 to different locations or zones of the reflective surface S1. this permits different zones of refractive face 5 to act upon reflected rays R1 and R2 and selectively bend them to reduce the final divergence between the reflected rays of light. This differs from FIG. 3 wherein zone Z1 reflects light from both luminescent elements hence a refractive surface placed in front of zone Z1 would not substantially reduce the distance D8 because the same portion of refractive surface would act on both light rays.

Figure 5:
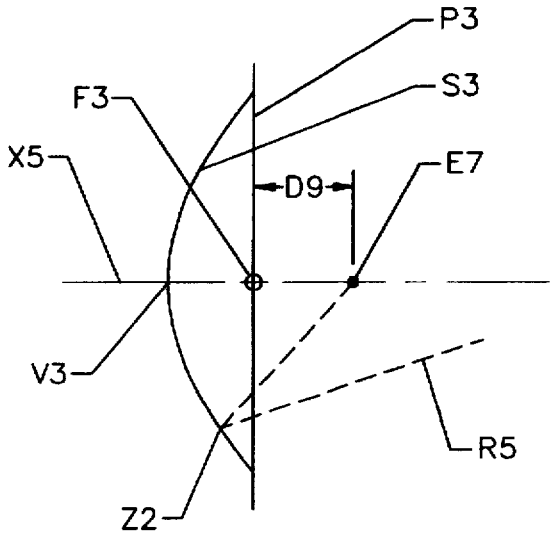
Fig. 5 (PRIOR ART)
FIG. 5 is a diagrammatic view of a parabolic reflector with a single luminescent light source located axially in front of the focal point.

FIG. 5 is a prior art diagrammatic view of a parabolic reflector S3 having axis of revolution X5, vertex V3, focal point F3 and focal plane P3. Luminescent element E7 is located a distance D9 in front of focal point F3 on the side of focal plane P3 opposite vertex V3. Light ray R5 impinging on zone Z2 is redirected by reflector S3 and immediately converges then finally diverges from axis X5.

Figure 6:
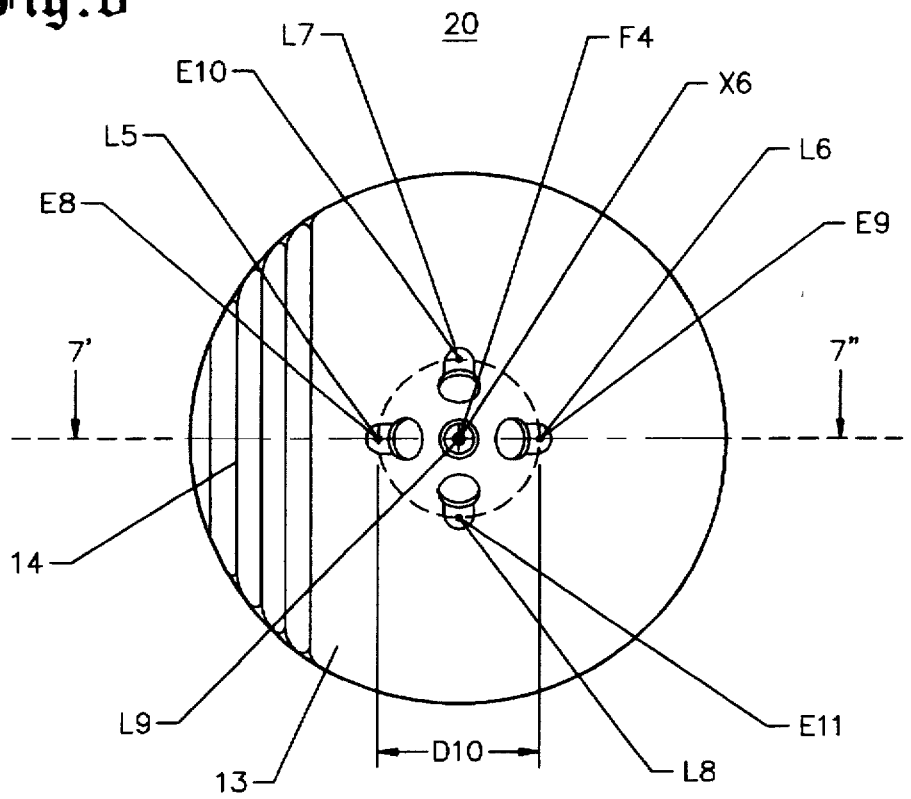
FIG. 6 is a front view of a lighting assembly including a hyperbolic reflector and a plurality of LED lamps.
Figure 7:
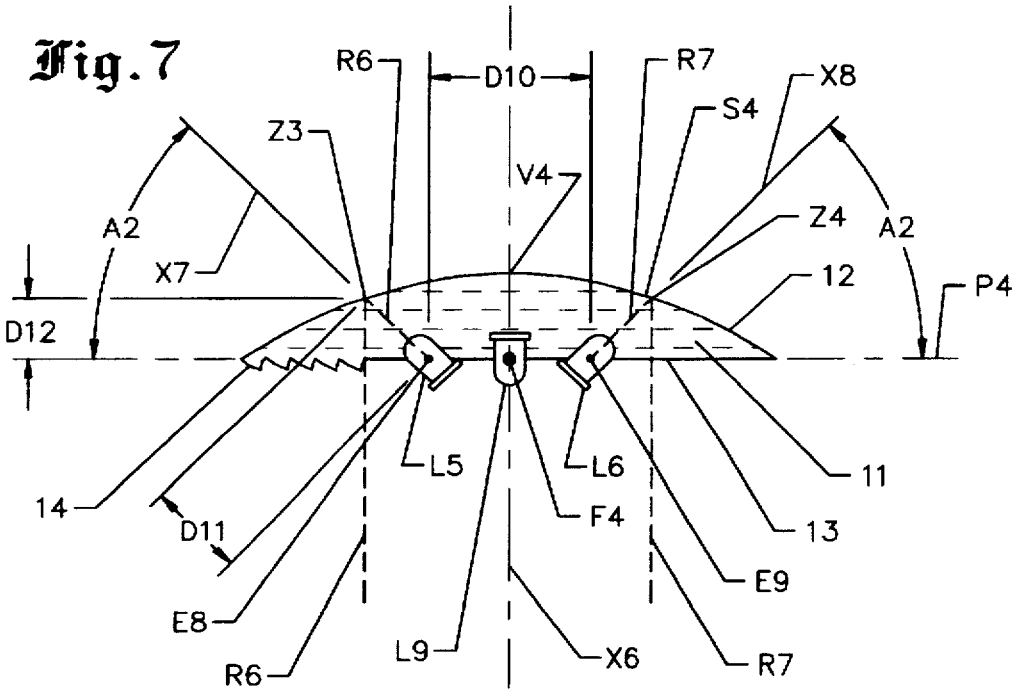
FIG. 7 is a diagrammatic cross-sectional view through line 7'—7" of the FIG. 6 assembly.

FIGS. 6 and 7 are front and cross-sectional views of hyperbolic reflector/lamp assembly 20. Solid transparent medium 11 is cast with a concave hyperbolic rear contour 12 and front surface 13. Hyperbolic rear contour 12 developed about interior focal point F4 and transverse axis of revolution X6 is coated with a reflective coating forming reflector S4 having reflective zones Z3 and Z4. Other parameters such as the location of the second exterior focal point, necessary to construct hyperbolic contour 12 would have to be determined for each design. Each reflective zone is located on a selected side of focal plane P4 and does not contain vertex V4. This—as described in FIG. 3—assures that all of the light rays reflected by a particular zone are redirected in the same general direction such that they all become more convergent or divergent to an appropriate reference line such as the axis of revolution. The size of each zone is usually sufficient to capture all the emitted light along the directions of the spatial radiation pattern for which the intensity exceeds a defined percentage of peak intensity. Four LED lamps L5, L6, L7, and L8 are positioned on diametrical distance D10 with their luminescent elements E8, E9, E10, and E11 equally spaced on a circle centered about focal point F4 and on focal plane P4. The lamps are partially encapsulated in transparent medium 11. Cross-sectional drawing FIG. 7 taken through line 7'—7" of FIG. 6 shows typical LED lamps L5 and L6 held so that their respective geometric axes X1 and X8 each intersect focal plane P4 at angle A2.

The distance between focal point F4 and vertex V4 of hyperbolic reflector S4 will be smaller than the corresponding distance for an equivalent parabolic reflector with the same outside diameter. This is beneficial because it further reduces the mass of the transparent medium correspondingly improving the precision of the cast contour improving the efficiency of the lighting device.

Forward facing LED lamp L9 positioned in transparent medium 11 projects an intense rectangular light beam to combine with light reflected from reflector S4 to form a composite beam with an especially bright central zone. This supplementary light beam can add to reflected light to achieve conformance to complex specifications. LED lamp L9 can alternatively have its direction reversed so that it will add to the light redirected by reflector S4 and contribute to the objective of an evenly lit face. The divergence of this reflected light beam can be reduced using the concept of axial shifting of the lamp as described in FIG. 5.

Figure 8:
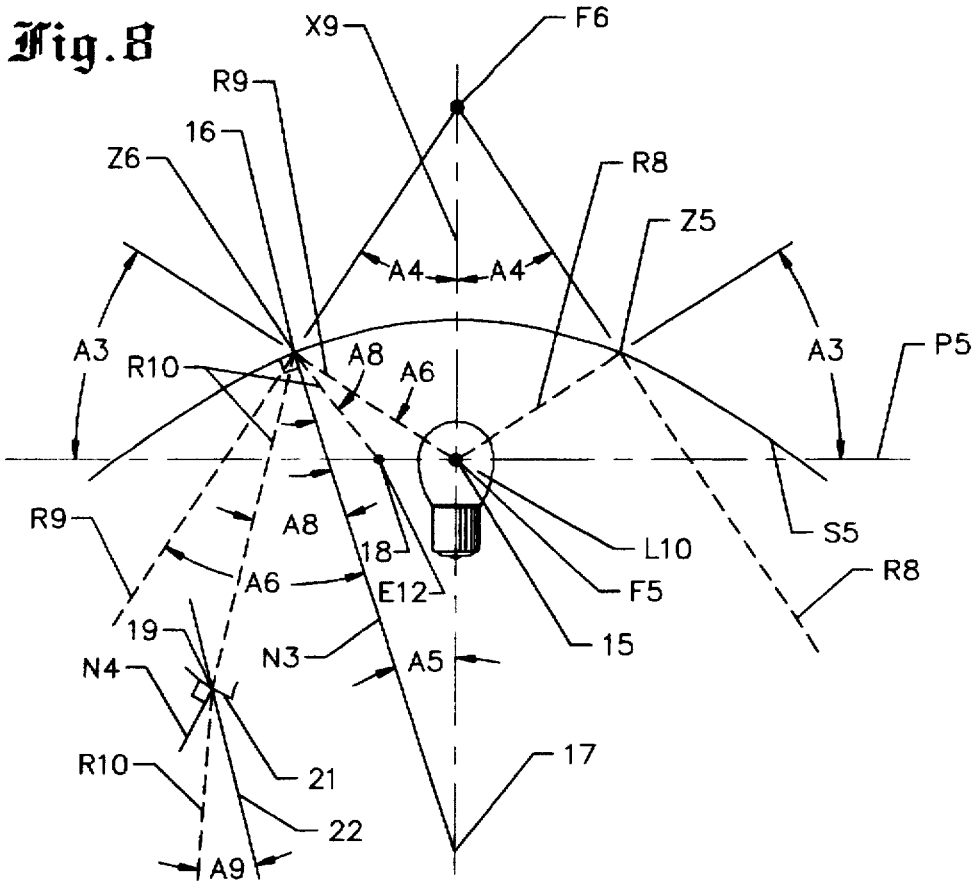
FIG. 8 is a diagrammatic side view of an incandescent lamp and hyperbolic reflector assembly.

Referring momentarily to FIG. 8, we have a diagrammatic side view of a typical hyperbolic reflector assembly including interior focal point F5 on the concave side of reflector S5 and exterior focal point F6 connected by transverse axis of revolution X9. Focal plane P5 is perpendicular to transverse axis X9 at interior focal point F5. Incandescent lamp L10 with point source incandescent filament 15 located at interior focal point F5 emits typical light ray R8 which intersects focal plane P5 at angle A3. This ray is redirected by reflector S5 at reflective zone Z5 and immediately diverges from transverse axis X9 at angle A4. Similar but opposite light ray R9 redirected by reflector S5 at point of intersection 16 within reflective zone Z6 also immediately after reflection diverges from transverse axis X9 at angle A4. When extended back behind reflector S5, reflected light rays R8 and R9 intersect transverse axis X9 at their apparent point of emission exterior focal point F6. Thus, when an incandescent source of light is located at the interior focal point of hyperbolic reflector S5. Typical reflected light rays R8 and R9 are immediately diverging forming a single diverging output beam with a geometric axis coincident with axis of revolution X9. Incandescent filament 15 radiates light of almost equal intensity in all directions and consequently the light impinges on reflective zones Z5 and Z6 located on opposite sides of axis of revolution X9. Therefore in accordance with the description of FIG. 3 moving filament 15 laterally off-focus on focal plane P5 will shift the direction of its geometric axis but not materially reduce the divergence of the output beam.

If, however, incandescent lamp L10 is replaced with several luminescent light sources laterally displaced from focal point F5, the objective of a more concentrated output beam can be achieved. Normal line N3 drawn perpendicular to reflector S5 at point of intersection 16 intersects axis of revolution X9 at point 17 forming included angle A5. Light ray R9 emitted from filament 15 intersects normal N3 forming included angle A6 whereupon in accordance with the physical laws of reflection it is reflected on the opposite side of normal N3 at an equal reflected angle A6. If reflected angle A6 is equal to angle A5 reflected ray R9 will be parallel to axis X9. If similar rays such as R8 were similarly parallel to axis X9 they would also be parallel to ray R9 and combine to form a concentrated output beam. Increasing the parallelism amongst the multiple light rays reflected from reflector S5 will increase the intensity of the projected composite output light beam. This objective can be achieved by making the magnitude of each rays reflected angle as close as possible to the magnitude of angle formed at the intersection of its normal and axis of revolution X9. In order to achieve this objective for the hyperbolic reflector shown we can replace incandescent filament 15 with typical luminescent element E12 located laterally off-focus at point 18 with its directional light output impinging upon zone Z6. With this configuration, light ray R10 emitted from luminescent element E12 along its geometric housing axis impinges upon reflector S5 at point of intersection 16 forming included angle A8 with normal N3 whereupon it is reflected on the opposite side of normal N3 at reflected angle A8. Since angle A8 is closer in magnitude to angle A5 then angle A6, ray R10 is more parallel to axis X9 then ray R8. Since luminescent element E12 emits only minimal light towards opposite zone Z5, we need not be concerned that zone Z5 will reflect a beam of light less parallel to axis X9. Zone Z5 can be beneficially used because a second luminescent element placed symmetrically opposite to luminescent element E12 will direct its light onto zone Z5 to create a second reflected light ray also more parallel to axis X9. A plurality of luminescent elements can cooperate in a similar fashion to produce a concentrated composite output beam formed from a plurality of substantially parallel light rays generated from a plurality of light sources. If the reflected beams are not as parallel as desired a refractive optic can be employed to further enhance their parallelism. If after reflection light ray R10 passed through tooth shaped optic 21 at point 19, it would be refracted away from normal N4 perpendicular to the surface of that optic In accordance with the laws of refraction. Reference line 22 drawn parallel to normal N3 and passing through point 19 intersects refracted ray R10 at angle A9 which is even closer in magnitude to angle A5 then was angle A8 indicating refracted ray R10 is more parallel to axis X9 then was reflected ray R10.

The concept can similarly be employed using other shapes such as an elliptical reflector which has two focal points both on the concave side of the reflector. In the classical elliptical design with a single light source light emitted from a first focal point near the vertex of the ellipse reflects and converges towards the axis of revolution and the second focal point. Using the concepts developed in the current invention, two LED lamps are each laterally shifted away from its reflective zone so that its light impinges upon that reflective zone at an increased angle of incidence. This increases the angle of reflection reducing the convergence and enhancing the parallelism of the two reflected beams. Unfortunately, shifting each LED away from its reflective zone as required by the elliptical design increases the distance through which the emitted light must pass and thus increases the attenuation due to the transparent medium. Therefore, in many instances, the hyperbolic reflector is more desirable.

Now referring back to FIGS. 6 and 7 with the concepts described in FIG. 8 in mind, typical light ray R6 emitted from LED L5 along its geometrical housing axis intersects focal plane P4 at angle A2. This ray travels distance D11 and is redirected by reflector S4 at zone Z3 whereupon it travels distance D12 and exits the lighting device parallel to axis of revolution X6. Due to the directional spatial radiation pattern of LED lamp L5—to be later described—minimal light is reflected from zone Z4. This is essential for the success of the design because if light were reflected from zone Z4 the reflected light would have increased divergence from axis X6 countering the converging shift towards axis X6 from zone Z3 adversely maintaining the overall divergence of the output beam. A similar situation exists for LED lamp L6 in which its reflected beam R7 is made more parallel to axis X6 by its off-focus location. Since each LED lamp is now creating a reflected beam which has enhanced parallelism to axis X6 the beams are more parallel to each other and can combine to form a concentrated composite output beam.

As described in FIG. 8 a hyperbolic reflector normally creates a diverging beam which is undesirable for many lighting devices. However, in FIGS. 6 and 7 a plurality of LED lamps which have directional spatial radiation patterns cooperate with hyperbolic reflector S4 and possibly lenses or flutes 14 to create a concentrated composite projected beam. By positioning luminescent element E8 of LED lamp L5 laterally off-focus and closer to zone Z3 of reflector S4 reflected light ray R6 emerges more parallel to axis X6. Geometric axis X7 of LED lamp L5 and geometric axis X8 of LED lamp L6 are angled with respect to axis of revolution X6 so that the light from each lamp impinges upon reflector S4 with a pattern that is unsymmetrical about axis of revolution X6. This permits selective control of the reflected beams by adjusting the curve of reflector S7 or by adding a selective refractive lens.

It is to be noted that it is not possible for two light beams—or their axes—to be perfectly parallel. If they are in the same plane, they will always intersect even though the included angle may be infinitesimally small. If they are not in the same plane, then their projections in a reference plane—similarly never perfectly parallel—will always intersect. Thus for our description, we seek to reduce the included angle of intersection of the geometric axes of the light beams—or their projections in an appropriate reference plane—in order to enhance the parallelism of the beams. Usually we strive to increase the parallelism of the geometrical beam axes to the degree that the projected beam patterns touch or overlap at the specification distance in the specification plane. This objective is more easily achieved if each of the beams has a large beamwidth because the geometric beam axes do not have to be perfectly parallel but need only intersect at an included angle with a magnitude less than one half the sum of the beamwidths.

Optional refracting flutes 14—similar to tooth 21 of FIG. 8—are partially shown on one side of front surface 13 there they will refract light primarily from LED lamp L5. Thus the light from each LED lamp can—after reflection from its particular reflective zone—be selectively refracted and redirected into a required portion of the composite beam pattern-This selective refraction permits control of the shape of the composite output beam beyond what is possible using uniformly emitting incandescent light sources because flutes 14 would redirect substantial amounts of light from all the sources precluding the necessary selective control. Flutes of a variety of shapes can be incorporated covering the entire face or only a particular zone to achieve a desired composite beam.

Figure 9:
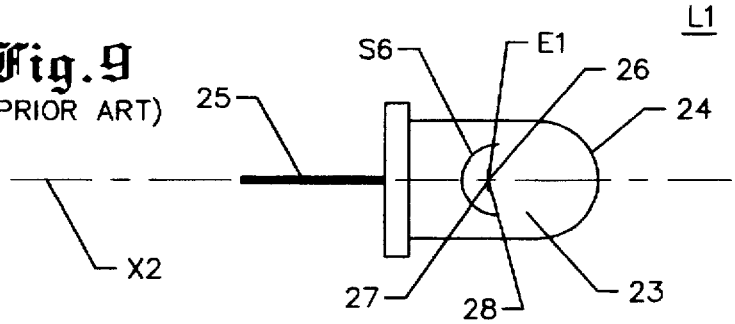
Fig. 9 (PRIOR ART)
FIG. 9 is a diagrammatic top view of a typical LED lamp with a lens top housing.

FIG. 9 is a diagrammatic view of a lens top LED lamp L1 from FIG. 2. LED lamp L1 is typical of lamps L1 thru L9 as previously described. LED lamp L1 includes LED housing 23—commonly constructed of a transparent epoxy with an index of refraction approximating 1.5 encapsulating luminescent element E1 and auxiliary concave reflector S6. Power lead 25 is one of two leads necessary apply power to luminescent element E1. Luminescent element E1 is usually planer with two substantially flat rectangular faces and thin sides. The front face 26 emits light in a spatial radiation pattern which is a function of its projected surface area in each selected direction. The peak Intensity is usually along the geometric axis of the spatial radiation pattern which, in this configuration, Is perpendicular to the rectangular face and coliniar with geometrical housing axis X2. The intensity decreases with increasing angular divergence from axis X2. Light emitted from the front face 26 of luminescent element E1 passes through lens 24 and is concentrated into a light beam projected from the front of the lamp. The rear face 27 is reflectorized to redirect its light towards lens 24 where it adds to the forwardly emitted light. Light emitted from the side 28 is redirected by concave auxiliary reflector S6 into lens 24 so that it also contributes to the forwardly projected light beam. The physical laws of refraction limit the solid angle of light lens 24 can collect from luminescent element L1. Therefore, substantial amounts of light energy do not pass through lens 24 and do not add to the intensity of the projected light beam.

Figure 10:
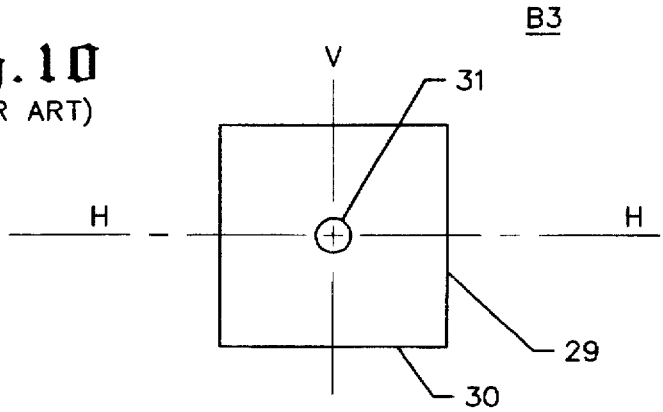
Fig. 10 (PRIOR ART)
FIG. 10 is a view of the projected beam pattern from the FIG. 9 LED lamp.

FIG. 10 shows a typical projected light beam pattern B3 from LED L1 of FIG. 9 with a rectangular contour including side 29, base 30 and low intensity central area 31. The low intensity central area is the result of the lens 24 magnifying the dark electrical connection into luminescent element El. The geometrical housing axis X2 of LED lamp L1 is coliniar with the line formed at the intersection of the horizontal H and vertical V planes. The actual shape of beam pattern B3 need not be rectangular for every LED lamp but will be a function of the shape and size of luminescent element El, auxiliary reflector S6, the geometry and material of housing 23, and lens 24. Typically beam pattern B3 includes light from all directions of the spatial radiation pattern which exceed a defined percentage of the peak intensity. The defined percentage can vary. Fifty percent is commonly used for discrete LED lamps with ten percent quoted in many signal light specifications.

Figure 11:
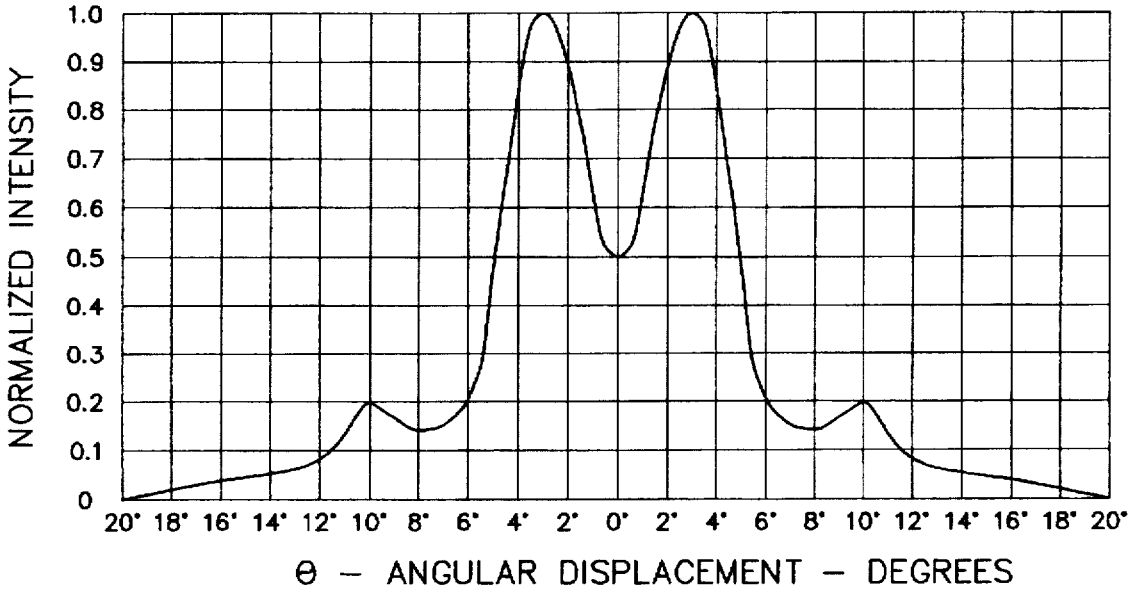
Fig. 11 (PRIOR ART)
FIG. 11 is a graph of intensity verses angular displacement of the FIG. 9 LED lamp as measured in the horizontal plane.

FIG. 11 shows a normalized graph of intensity versus angular displacement taken in degrees along the horizontal plane of the projected light beam of the FIG. 9 LED lamp. This graph shows that the direction of peak intensity diverges by approximately 3 degrees from the geometric axis of the spatial radiation pattern. In the direction along geometrical housing axis X2, the intensity measures 50% of the peak intensity. Also, in the horizontal plane all light rays along directions equal to or exceeding 50% of peak intensity are located within an included angle of 10 degrees. This included angle is the beamspread and it is proportional to the length of the base 30 of beam pattern B3 of FIG. 10.

Figure 12:
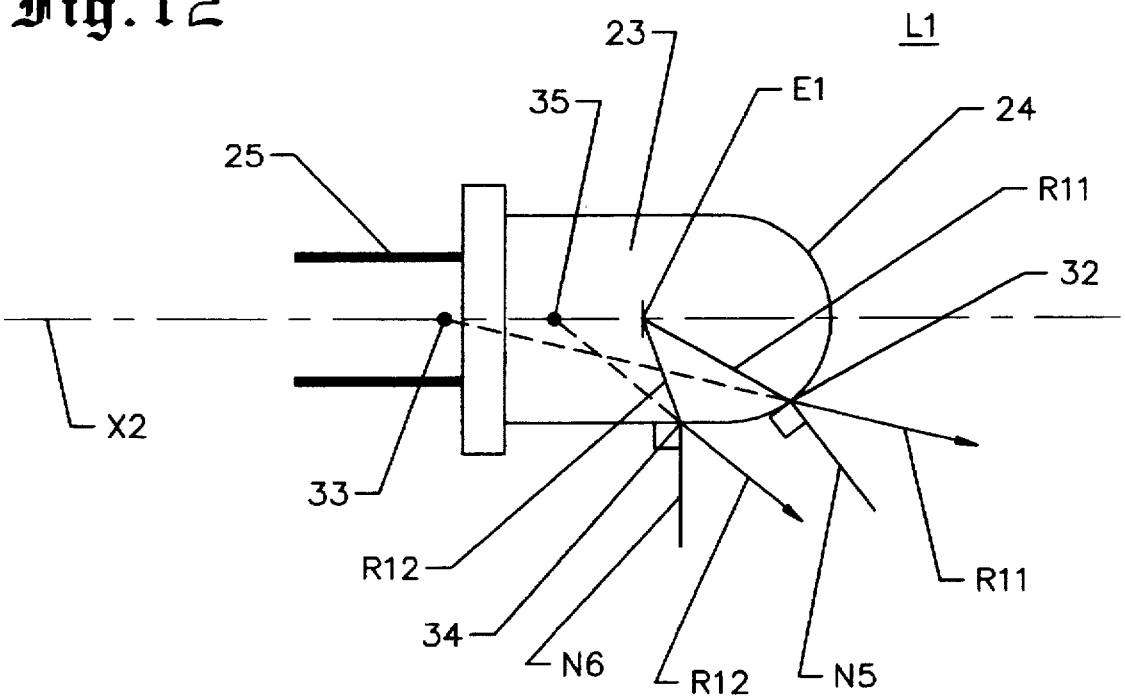
FIG. 12 is an enlarged diagrammatic side view of the FIG. 9 LED lamps showing the path of two typical emitted light rays.

FIG. 12 is an enlarged diagrammatic side view of LED lamp L1 as shown in FIG. 9 with auxiliary reflector S6 removed for clarity. Two light rays are traced as they emerge from housing 23. Ray R11 emerges at point 32 and is refracted. If refracted Ray R11 is projected back into LED lamp L1, it intersects geometrical axis X2 at apparent point of emission 33. Similarly, Ray R12 emerges at point 34 and is refracted. If refracted ray R12 is projected back into LED lamp L1 it intersects geometrical axis X2 at apparent point of emission 35. Normal lines N5 and N6 are drawn at emergent points 32 and 34 for reference purposes. Thus although LED lamp L1 has only one actual luminescent element E1, rays R11 and R12 appear to originate from separate emission points 33 and 35. Other rays not shown could create other apparent emission points making it appear that single luminescent element L1 is a plurality of sources or an enlarged source. Thus luminescent element L1 can, if used with a reflector, appear to the reflector at its actual size and location or appear enlarged and at a new location depending upon the extent of refraction the emitted light experiences as it leaves housing 23. If the light is to be subsequently reflected the efficiency of the lighting device will be improved by using the apparent point of emission rather then the actual point of emission relative to the focal point of the reflector during the optical design.

The lens top LED lamp as shown in FIG. 9 is advantageously used in cooperation with the concave reflector because it emits a concentrated beam of light and requires less of the reflectors surface area. However, other LED housings can also be employed.. A spherical housing LED permits the light emitted by its luminescent element to exit the housing along the direction of the normal to that housing and therefore, does not bend the light or create enlargement or shifting of the luminescent element.

Figure 13:
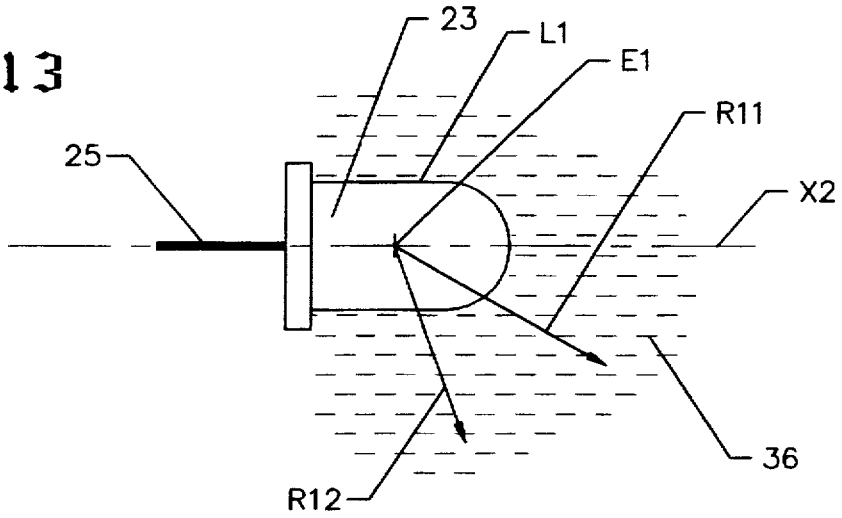
FIG. 13 is a diagrammatic side view of the FIG. 9 LED lamp surrounded by a transparent medium.

FIG. 13 is a diagrammatic side view of LED lamp L1 similar to FIG. 12 except it is surrounded by primary transparent medium 36 with an index of refraction equal to the index of refraction of housing 23. Light rays R11 and R12 first seen in FIG. 12 are again traced as they leave the housing. No refraction or bending occurs and the emerging rays do not change their direction. The emerging rays appear to originate from their true point of emission and luminescent element El does not appear enlarged. Some undesirable refraction or bending of light would remain if the indicies of refraction of housing 23 and primary transparent medium 36 were not identical. Nevertheless, any reduction in the difference between the indicies of refraction of housing 23 and transparent medium 36 would beneficially reduce the apparent shifting or enlargement of the luminescent element.

Figure 14:
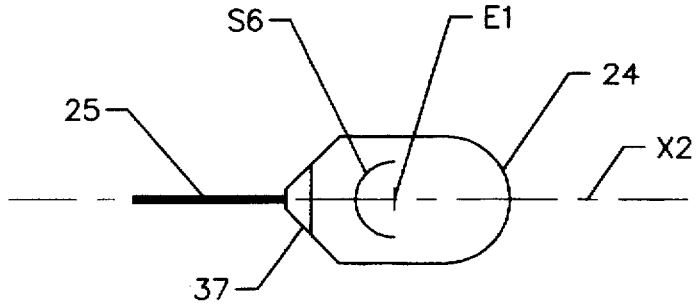
FIG. 14 is a diagrammatic view of the FIG. 9 LED lamp with the side cut-off.

FIG. 14 is LED lamp L1 from FIG. 9 modified by removing part of its housing at cutoff 37. This modification permits two of these LED lamps to be placed in close proximity with the distance between their luminescent elements held to a minimum while retaining much of their large housing size. Maintaining most of the large housing assures adequate lens 24 magnification and heat dissipating capacity.

Figure 15:
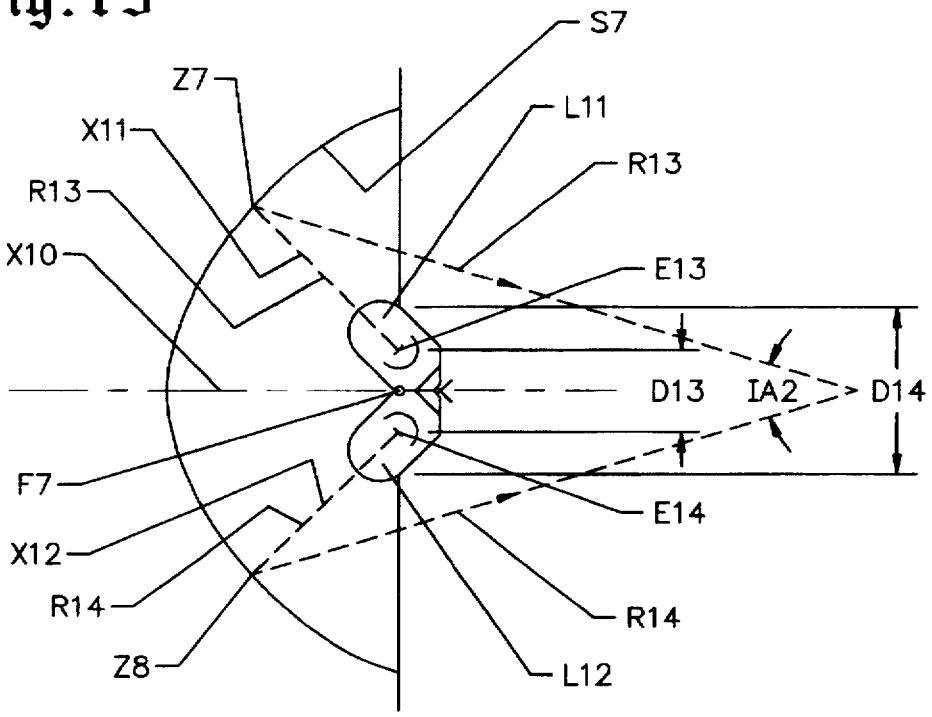
FIG. 15 is a diagrammatic side view of a reflector with two cut-off LED lamps as seen in FIG. 14.

FIG. 15 is a diagrammatic view of two modified LED lamps as described in FIG. 14 represented by LED lamps L11 and L12 positioned in close proximity in parabolic reflector S7.

Figure 16:
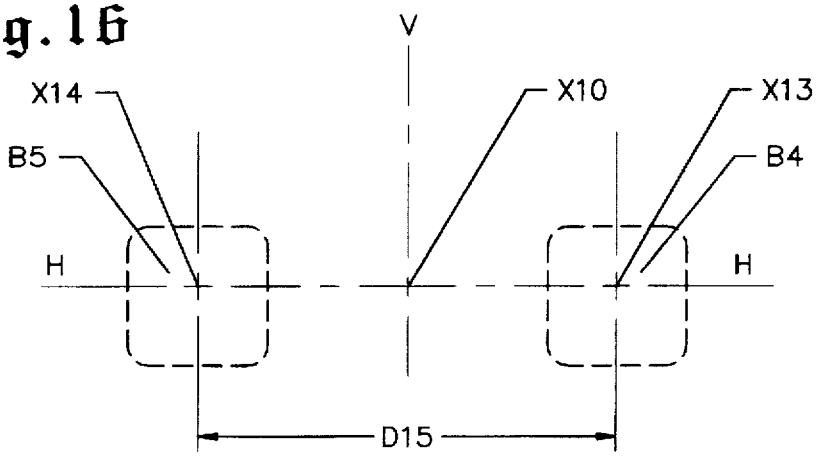
FIG. 16 is the projected light beam pattern from the FIG. 15 assembly.

FIG. 16 is the projected beam pattern of the FIG. 15 assembly with axis of revolution X10 aligned with the intersection of the horizontal H and vertical V planes. Referring back to FIG. 15, light ray R13 emitted from luminescent element E13 of LED lamp L11 along its geometric housing axis X11 is redirected by reflector S7 at zone Z7. It converges upon axis of revolution X10 then diverges forming beam pattern B4 with geometric beam axis X13. Similarly, light ray R14 emitted from luminescent element E14 of LED lamp L12 along its geometric housing axis X12 is redirected at zone Z8. It converges upon axis of revolution X10 then diverges forming beam pattern B5 with geometric beam axis X14. Light ray R13 and light ray R14 intersect to form included angle IA2. The distance between geometric beam axes X13 and X14 is D15 and it is proportional to the distance D13 between luminescent elements E13 and E14. Reducing distance D15 increases the concentration of the projected light and permits beam patterns B4 and B5 to more easily combine to form a composite beam pattern meeting a specific specification requirement. This is achieved by using two LED lamps L11 and L12 as described in FIG. 14 permitting them to be positioned with their cut-offs 37 in contact achieving a reduction distance D13 between luminescent elements E13 and E14 without the corresponding reduction in the lens or housing mass that a typical smaller lamp housing would create. Distance D14 the dimension from the exterior contour of lamp L12 to the exterior contour of lamp L11 as measured along a line passing through the luminescent elements is larger than twice distance D13. This indicates that over fifty percent of the mass of the housings are located exterior to the space between the luminescent elements. This benefits the design without increasing the divergence.

Distance D15 is proportional to the angular divergence between the geometric beam axes X13 and X14. If this angular divergence can be reduced such that beam patterns B4 and B5 touch then the two beams have been combined in a defined plane to form a composite beam at a defined distance from the lighting device.

Although FIGS. 2 and 7 show luminescent elements with a substantial space between them, actual designs whether using standard or modified cut-off lamp housings would minimize this distance as seen in FIG. 15. Angling the lamps as shown in all the figures permits heat generated by their luminescent elements to be conducted by the housing away from the center of the group of lamps avoiding a central hot zone that can cause overheating. If the geometrical housing axes of the lamps are in the same plane, it is desirable that the included angle of intersection exceed 20 degrees.

Angling a luminescent light source either with or without a housing with respect to the axis of revolution of the concave reflector permits its emitted energy to be collected and projected by the reflector with the desired minimal beam divergence. It has been found desirable that the included angle of intersection between the geometrical axis of the spatial radiation pattern and axis of revolution of the reflector exceed 10 degrees. If the axes are in different planes, the projection of the axis of the spatial radiation pattern upon a reference plane used to measure the 10 degree angle.

Figure 17:
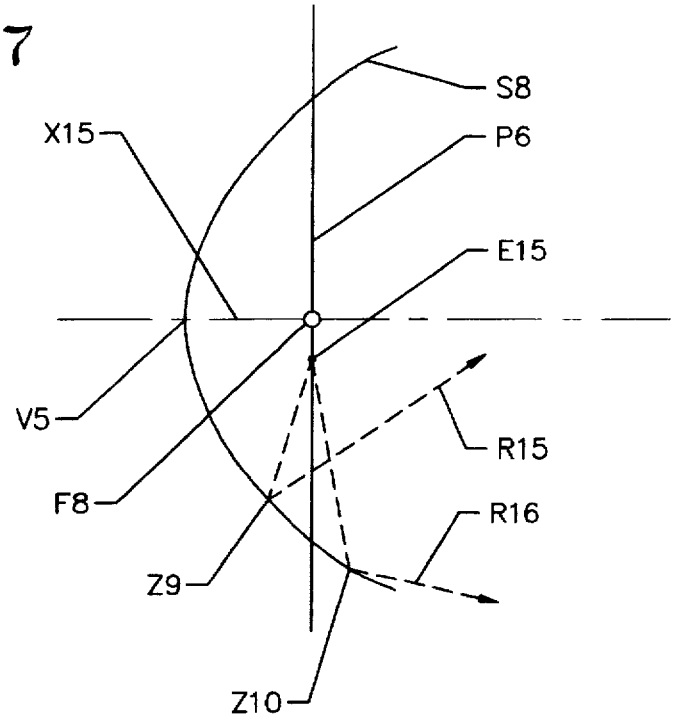
FIG. 17 is a diagrammatic side view of a reflector located on both sides of its focal plane with a luminescent element positioned a distance from the focal point.

FIG. 17 is a diagrammatic side view of a reflector S8 having axis of revolution X15, focal point F8, focal plane P6 and vertex V5. Luminescent element E15 is positioned laterally away from focal point F8 along focal plane P6. Light ray R15 emitted from luminescent element E15 towards zone Z9 on vertex V5 side of focal plane P6 is redirected and converges upon axis of revolution X15. Light ray R16 emitted from luminescent element E15 towards zone Z10 on the side of focal plane P6 opposite vertex V4 is redirected and diverges from axis of revolution X15.

Thus FIG. 17 relates lateral source shifting to reflected beam direction for both the rearward or vertex side of focal plane and forward of focal plane reflectors. All Applicant's preferred embodiments use reflectors which lie on the rearward or vertex side of their respective focal planes. The displacement and direction of the sources relative to the focal point of the rearward reflector in these embodiments reduce the overall final divergence between the output beams of the lighting device. Reflectors forward of their focal planes can obviously be used. However, the effect of the location of the light source must be correlated with the particular reflector to assure reduction of the between beam divergence for each design.

Referring back to FIG. 3, it can now be seen that lateral off-focus shifting of a directional light source will increase the convergence of its reflected light beam relative to the axis of revolution of the reflector if the shift is towards the reflective zone that is being employed providing that reflective zone is on the vertex side of the focal plane. Using this information, a plurality of light sources can each be positioned so that each reflected light beam becomes more convergent to the axis of revolution of the reflector. If the reflector is hyperbolic, this convergence is balanced by the diverging effect of the contour resulting in enhanced parallelism of the plurality of reflected light beams.

Now referring to FIG. 11 it can be seen that LED light sources emit their light with a spatial radiation pattern that can have a substantial angular beamspread. This is especially true when the beamspread includes all directions exceeding 10 percent of peak intensity. Regardless of its magnitude, it is desirable that all of the light within the beamspread impinge upon its reflective zone according to the previously described requirements so that the entire beam will be redirected as necessary. If for example, a lamp has a beamspread of 20 degrees, it should be angled in excess of 10 degrees both to the axis of revolution and to the focal plane of the reflector so that the entire beam impinges upon a correct zone of the reflector.

Figure 18:
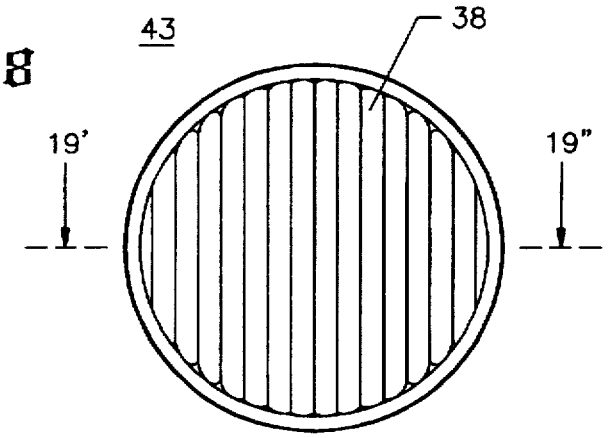
FIG. 18 is a front view of a lighting assembly with a plurality of luminescent lamps.
Figure 19:
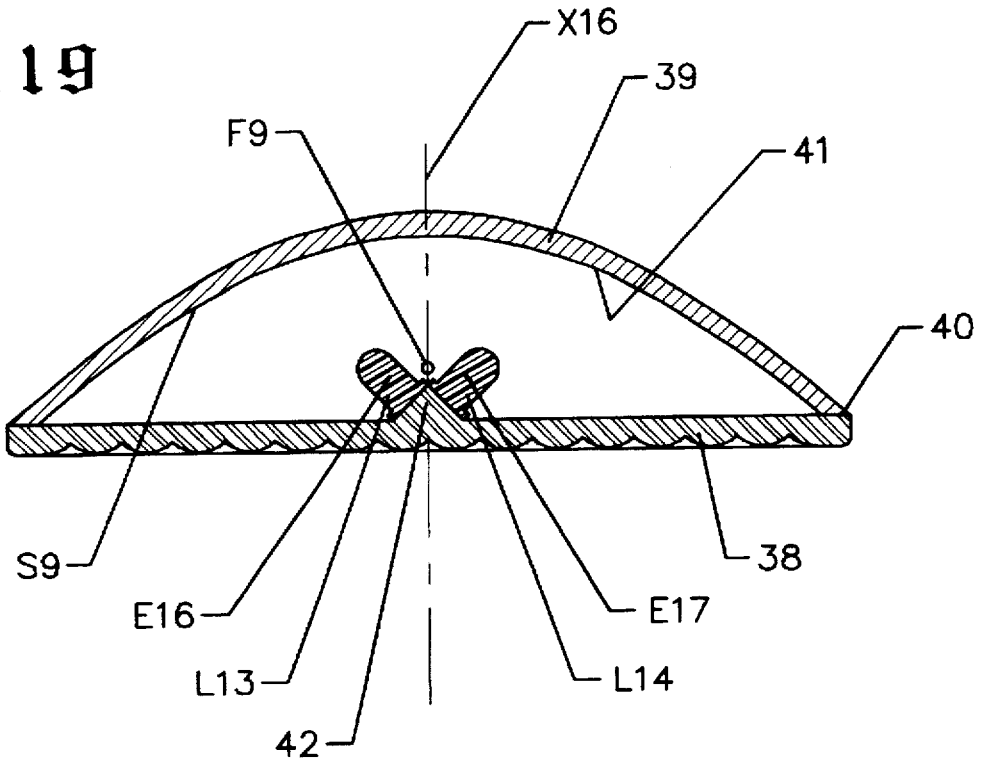
FIG. 19 is a cross-sectional view of the FIG. 18 lighting assembly taken along line 19'—19".

FIGS. 18 and 19 are front and cross-sectional views of lighting assembly 43 which includes fluted lens 38 cemented to body 39 at rim 40. Body 39 has a hyperbolic inside contour 41 with axis of revolution X16 and interior focal point F9. A reflective coating applied to interior concave contour 41 forms reflector S9. Lens 38 includes lamp support 42 which positions LED lamps L13 and L14 in their appropriate location. Since no light transmitting medium is used, the location of LED lamps L13 and L14 would be determined using the apparent points of light emission as described in FIG. 12 and not the actual points of emission at luminescent elements E16 and E17. Also, luminescent elements E16 and E17 would—due to refraction as described in FIG. 12—appear enlarged causing their light beams to have undesirably large individual divergences.

Lighting assembly 43 could be filled with a transparent medium to reduce the apparent enlargement of the luminescent elements. The use of a transparent medium improves the efficiency and furthers the objective of creating an evenly lit face. Small amounts of light emitted from lamp L13 and redirected by reflector S9 impinges upon the housing of lamp L14 where it is refracted and lost. If a transparent medium is used, the housing from LED lamp L14 does not refract this light permitting it to pass through to enter lens 38 and add to the composite beam. Additional light emitted from lamp L13 impinges directly upon the housing of lamp L14 where it is also refracted and lost. If a transparent medium is used, this light also will pass directly through the housing of lamp L14 and reflect from reflector 89 adding to the even illumination of lens 38.

If a liquid transparent medium is selected it would need to possess the light and color transmission characteristics required for the solid medium. In addition, it would be of a substance such as alcohol or oil which resists freezing. The liquid has advantages over the solid in that it would transmit thermal energy by conduction and convection. It would also permit lighting device 43 to be constructed without thick sections which are difficult and expensive to mold with the high accuracy necessary for optical devices.

Having now fully set forth the preferred embodiments and Having now fully set forth the preferred embodiments and certain modifications of the concept underlying the present invention, various other embodiments as well as certain variations and modifications of the embodiment herein shown and described will obviously occur to those skilled in the art upon becoming familiar with said underlying concept. For instance, although this disclosure centered on visible light, the concepts described and the term light are meant to include all electromagnetic radiated energy including the infrared portion of the spectrum. In addition, although most designs would use LED lamps with discrete housings which are readily available, many of the concepts can be applied using luminescent elements without housings.

It is to be understood, therefore, that within the scope of the appended claims, the invention may be practiced otherwise than as specifically set forth herein.

What is claimed is:

1. A high efficiency lighting device including:

a) a primary mirrored reflector conforming to a concave surface of revolution, said concave surface of revolution having an axis of revolution;

b) a first light source including a first luminescent element emitting light in a first directional spatial radiation pattern, said first light source oriented relative to said primary mirrored reflector such that a percentage of said emitted light impinges upon a first reflective zone of said primary mirrored reflector, said percentage of said emitted light reflected at said first reflective zone to form a first light beam having a first geometric beam axis;

c) a second light source including a second luminescent element emitting light in a second directional spatial radiation pattern said second light source oriented relative to said primary mirrored reflector such that a percentage of said emitted light impinges upon a second reflective zone of said primary mirrored reflector, said percentage of said emitted light reflected at said second reflective zone to form a second light beam having a second geometric beam axis;

d) the projection of said first geometric beam axis upon a reference plane intersects the projection of said second geometric beam axis upon said reference plane to form an included angle;

e) means to curve said primary mirrored reflector to cooperate with said orientation of said first light source and said orientation of said second light source to reduce said included angle.

2. A high efficiency lighting device including:

a) a primary mirrored reflector conforming to a concave surface of revolution, said concave surface of revolution having an axis of revolution;

b) a first light source including a first luminescent element emitting light in a first directional spatial radiation pattern, said first light source oriented relative to said primary mirrored reflector such that said first luminescent element is separated from said axis of revolution and a percentage of said emitted light impinges upon a first reflective zone of said primary mirrored reflector, said percentage of said emitted light reflected at said first reflective zone to form at a first distance from said lighting device a first beam pattern having a first geometric axis;

c) a second light source including a second luminescent element emitting light in a second directional spatial radiation pattern, said second light source oriented relative to said primary mirrored reflector such that said second luminescent element is separated from said axis of revolution and a percentage of said emitted light impinges upon a second reflective zone of said primary mirrored reflector, said percentage of said emitted light reflected at said second reflective zone to form at said first distance from said lighting device a second beam pattern having a second geometric axis;

d) said second geometric axis spaced at a second distance from said first geometric axis; and, e) means to curve said primary mirrored reflector to cooperate with said orientation of said first light source and said orientation of said second light source to reduce said second distance.

3. A high efficiency lighting device including:

a) a primary mirrored reflector conforming to a concave surface of revolution, said concave surface of revolution having an axis of revolution;

b) a first light source including a first luminescent element emitting light in a first directional spatial radiation pattern, said first light source oriented relative to said primary mirrored reflector such that said first luminescent element is separated from said axis of revolution and a percentage of said emitted light impinges upon a first reflective zone of said primary mirrored reflector, said percentage of said emitted light reflected at said first reflective zone to form a first light beam;

c) a second light source including a second luminescent element emitting light in a second directional spatial radiation pattern, said second light source oriented relative to said primary mirrored reflector such that said second luminescent element is separated from said axis of revolution and a percentage of said emitted light impinges upon a second reflective zone of said primary mirrored reflector, said percentage of said emitted light reflected at said second reflective zone to form a second light beam;

d) said second light beam at a distance from said lighting device diverging from said first light beam; and, e) means to curve said primarily mirrored reflector to cooperate with said orientation of said first light source and said orientation of said second light source to reduce said divergence.

4. A high efficiency lighting device including:

a) a primary mirrored reflector conforming to a concave surface of revolution, said concave surface of revolution having an axis of revolution;

b) a first light source including a first luminescent element emitting light in a first directional spatial radiation pattern, said first light source oriented relative to said primary mirrored reflector such that said first luminescent element is separated from said axis of revolution and a percentage of said emitted light impinges upon a first reflective zone of said primary mirrored reflector, said first light source further oriented such that said first reflective zone and said first light source are located on a first side of a first location reference plane, said first location reference plane is coincident with said axis of revolution, said percentage of said emitted light reflected at said first reflective zone to form at a first distance from said lighting device a first beam pattern having a first geometric axis;

c) a second light source including a second luminescent element emitting light in a second directional spatial radiation pattern, said second light source oriented relative to said primary mirrored reflector such that said second luminescent element is separated from said axis of revolution and a percentage of said emitted light impinges upon a second reflective zone of said primary mirrored reflector, said second light source further oriented such that said second reflective zone and said second light source are located on a first side of a second location reference plane, said second location reference plane is coincident with said axis of revolution, said percentage of said emitted light reflected at said second reflective zone to form at said first distance from said lighting device a second beam pattern having a second geometric axis;

d) said second geometric axis spaced at a second distance from said first geometric axis; and, e) means to curve said primary mirrored reflector to cooperate with said orientation of said first light source and said orientation of said second light source to reduce said second distance, said means comprising the curving of said primary mirrored reflector into a hyperbolic reflector.

5. A high efficiency lighting device including:

a) a primary mirrored reflector conforming to a concave surface of revolution, said concave surface of revolution having an axis of revolution;

b) a first light source including a first luminescent element emitting light in a first directional spatial radiation pattern, said first light source oriented relative to said primary mirrored reflector such that said first luminescent element is separated from said axis of revolution and a percentage of said emitted light impinges upon a first reflective zone of said primary mirrored reflector, said first light source further oriented such that said first reflective zone and said first light source are located on a first side of a first location reference plane, said first location reference plane is coincident with said axis of revolution, said percentage of said emitted light reflected at said first reflective zone to form a first light beam having a first geometric beam axis;

c) a second light source including a second luminescent element emitting light in a second directional spatial radiation pattern, said second light source oriented relative to said primary mirrored reflector such that said second luminescent element is separated from said axis of revolution and a percentage of said emitted light impinges upon a second reflective zone of said primary mirrored reflector, said second light source further oriented such that said second reflective zone and said second light source are located on a first side of a second location reference plane, said second location reference plane is coincident with said axis of revolution, said percentage of said emitted light reflected at said second reflective zone to form a second light beam having a second geometric beam axis;

d) the projection of said first geometric beam axis upon a reference plane intersects the projection of said second geometric beam axis upon said reference plane to form an included angle;

e) means to curve said primary mirrored reflector to cooperate with said orientation of said first light source and said orientation of said second light source to reduce said acute Included angle, said means comprising the curving of said primary mirrored reflector into a hyperbolic reflector.

6. A high efficiency lighting device including a) a primary mirrored reflector conforming to a concave surface of revolution, said concave surface of revolution having an axis of revolution;

b) a first light source including a first luminescent element emitting light in a first directional spatial radiation pattern, said first light source oriented relative to said primary mirrored reflector such that said first luminescent element is separated from said axis of revolution and a percentage of said emitted light impinges upon a first reflective zone of said primary mirrored reflector, a first light refracting optic, said percentage of said emitted light reflected at said first reflective zone subsequently refracted by said first light refracting optic to form a first light beam having a first geometric beam axis;

c) a second light source including a second luminescent element emitting light in a second directional spatial radiation pattern, said second light source oriented relative to said primary mirrored reflector such that said second luminescent element is separated from said axis of revolution and a percentage of said emitted light impinges upon a second reflective zone of said primary mirrored reflector, said percentage of said emitted light reflected at said second reflective zone to form a second light beam having a second geometric beam axis;

d) the projection of said first geometric beam axis upon a reference plane intersects the projection of said second geometric beam axis upon said reference plane to form an included angle;

e) means to curve said primary mirrored reflector to cooperate with said orientation of said first light source and said orientation of said second light source to reduce said included angle.

7. A high efficiency lighting device including:

a) a primary mirrored reflector conforming to a concave surface of revolution, said concave surface of revolution having an axis of revolution;

b) a first light source including a first luminescent element emitting light in a first directional spatial radiation pattern, said first light source oriented relative to said primary mirrored reflector such that said first luminescent element is separated from said axis of revolution and a percentage of said emitted light impinges upon a first reflective zone of said primary mirrored reflector, said percentage of said emitted light reflected at said first reflective zone forming a first reflected light beam, a first light refracting optic redirecting said first reflected light beam to form at a first distance from said lighting device a first projected beam pattern having a first geometric axis;

c) a second light source including a second luminescent element emitting light in a second directional spatial radiation pattern, said second light source oriented relative to said primary mirrored reflector such that said second luminescent element is separated from said axis of revolution and a percentage of said emitted light impinges upon a second reflective zone of said primary mirrored reflector, said percentage of said emitted light reflected at said second reflective zone forming a second reflected light beam, a second light refracting optic redirecting said second reflected light beam to form at said first distance from said lighting device a second projected beam pattern having a second geometric axis;

d) said second geometric axis spaced at a second distance from said first geometric axis; and, e) means to curve said primary mirrored reflector to cooperate with said orientation of said first light source and said orientation of said second light source to reduce said second distance.

8. A high efficiency lighting device including:

a) a primary mirrored reflector conforming to a concave surface of revolution, said concave surface of revolution having an axis of revolution;

b) a first light source including a first luminescent element emitting light in a first directional spatial radiation pattern, said first light source oriented relative to said primary mirrored reflector such that said first luminescent element is separated from said axis of revolution and a percentage of said emitted light impinges upon a first reflective zone of said primary mirrored reflector, said percentage of said emitted light reflected at said first reflective zone forming a first projected light beam, a first light refracting optic redirecting said first reflected light beam to form a first refracted light beam having a first geometric beam axis;

c) a second light source including a second luminescent element emitting light in a second directional spatial radiation pattern, said second light source oriented relative to said primary mirrored reflector such that said second luminescent element is separated from said axis of revolution and a percentage of said emitted light impinges upon a second reflective zone of said primary mirrored reflector, said percentage of said emitted light reflected at said second reflective zone forming a second projected light beam a second light refracting optic redirecting said second reflected light beam to form a second refracted light beam having a second geometric beam axis;

d) the projection of said first geometric beam axis upon a reference plane intersects with the projection of said second geometric beam axis upon said reference plane to form an included angle; and, e) means to curve said primary mirrored reflector to cooperate with said orientation of said first light source and said orientation of said second light source to reduce said included angle.

9. A high efficiency lighting device including:

a) a primary mirrored reflector conforming to a concave surface of revolution, said concave surface of revolution having an axis of revolution;

b) a first light source including a first luminescent element emitting light in a first directional spatial radiation pattern, said first light source oriented relative to said primary mirrored reflector such that said first luminescent element is separated from said axis of revolution and a percentage of said emitted light impinges upon a first reflective zone of said primary mirrored reflector, said percentage of said emitted light reflected at said first reflective zone forming a first reflected light beam, a first light refracting optic redirecting said first reflected light beam to form a first refracted light beam having a first geometric beam axis;

c) a second light source including a second luminescent element emitting light in a second directional spatial radiation pattern, said second light source oriented relative to said primary mirrored reflector such that said second luminescent element is separated from said axis of revolution and a percentage of said emitted light impinges upon a second reflective zone of said primary mirrored reflector, said percentage of said emitted light reflected at said second reflective zone forming a second reflected light beam, a second light refracting optic redirecting said second reflected light beam to form a second refracted light beam having a second geometric beam axis;

d) said second refracted light beam at a distance from said lighting device diverging from said first refracted light beam; and e) means to curve said primary mirrored reflector to cooperate with said orientation of said first light source and said orientation of said second light source to reduce said divergence.

10. A high efficiency lighting device including:

a) a primary mirrored reflector conforming to a concave surface of revolution, said concave surface of revolution having an axis of revolution;

b) a plurality of light sources;

c) each said light source including a luminescent element emitting light in a directional spatial radiation pattern, each said light source oriented relative to said primary mirrored reflector such that said luminescent element is at a different location than said axis of revolution and a percentage of said emitted light impinges upon a reflective zone of said primary mirrored reflector where it is reflected to form a light beam having a geometric beam axis;

d) the projection of each said geometric beam axis upon a reference plane intersects the projection of said axis of revolution upon said reference plane to form an included angle;

e) means to curve said primary mirrored reflector to cooperate with said orientation of each said light source to reduce each said included angle.

11. A high efficiency lighting device as in any one of claims 1–10 wherein:

said first light source further includes a first transparent housing with a first exterior surface;

said second light source further includes a second transparent housing with a second exterior surface;

said first luminescent element is a light emitting diode, and;

said second luminescent element is a light emitting diode.

12. A high efficiency lighting device as in any one of claims 1–10 wherein;

said first light source further includes a first transparent housing with a first exterior surface;

said second light source further includes a second transparent housing with a second exterior surface;

said first transparent housing includes a light refracting optic to concentrate said percentage of said light emitted by said first luminescent element before it impinges upon said first reflective zone of said primary mirrored reflector, and;

said second transparent housing includes a light refracting optic to concentrate said percentage of said light emitted by said second luminescent element before it impinges upon said second reflective zone of said primary mirrored reflector.

13. A high efficiency lighting device as in any one of claims 1–10 wherein;

said first light source further includes a first transparent housing with a first exterior surface;

said second light source further includes a second transparent housing with a second exterior surface;

said first exterior surface includes a first spherical surface, wherein;

said percentage of said light emitted by said first luminescent element passes through said first spherical surface before impinging upon said first reflective zone of said primary mirrored reflector;

said second exterior surface includes a second spherical surface, wherein;

said light emitted by said second luminescent element passes through said second spherical surface before impinging upon said second reflective zone of said primary mirrored reflector.

14. A high efficiency lighting device as in any one of claims 7–9 wherein;

said concave surface of revolution has a parabolic contour.

15. A high efficiency lighting device as in any one of claims 1–3 wherein;

first reflective zone is located on a first side of a first location reference plane and said first light source is located on a second side of said first location reference plane, said first location reference plane is coincident with said axis of revolution;

said second light source is further oriented so that said second reflective zone is located on a first side of a second location reference plane and said second light source is located on a second side of said second location reference plane, said second location reference plane is coincident with said axis of revolution, and;

said means to curve said primary mirrored reflector comprises the curving of said primary mirrored reflector into an elliptical reflector.

16. A high efficiency lighting device as in claim 10 wherein;

said means to curve said primary mirrored reflector includes curving it into a hyperbolic reflector.

17. A high efficiency lighting device as in any one of claims 1–10 which further includes;

a solid primary transparent medium having an index of refraction exceeding 1.25 between each of said light sources and said primary mirrored reflector.

18. A high efficiency lighting device as in any one of claims 1–10 which further includes;

a primary transparent medium between each of said light sources and said primary mirrored reflector, said primary transparent medium having a transmissivity through a one inch thickness of at least 75 percent when measured using said light emitted by said first light source.

19. A high efficiency lighting device as in any one of claims 1–10 which further includes;

a primary transparent medium between each of said light sources and said primary mirrored reflector, said primary transparent medium is a solid contoured and reflectized to create said primary mirrored reflector.

20. A high efficiency lighting device as in any one of claims 1–10 which further includes;

a solid primary transparent medium between each of said light sources and said primary mirrored reflector contoured to create a light refracting optic.

21. A high efficiency lighting device as in any one of claims 1–10 which further includes;

a solid primary transparent medium between each of said light sources and said primary mirrored reflector.

said solid transparent medium is an acrylic plastic.

22. A high efficiency lighting device as in any one of claims 1–10 which further includes;

a liquid primary transparent medium between each of said light sources and said primary mirrored reflector.

23. A high efficiency lighting device as in any one of claims 1–9 wherein;

said first light source further includes a first concave mirrored auxiliary reflector to redirect light emitted by said first luminescent element into said primary mirrored reflector, and;

said second light source further includes a first concave mirrored auxiliary reflector to redirect light emitted by said second luminescent element into said primary mirrored reflector.

24. A high efficiency lighting device according to claims 1, 5, 6, 8 or 10 wherein;

said reference plane is the horizontal plane.

25. A high efficiency lighting device as in any one of claims 1–10 wherein;

for each said light source said directional spatial radiation pattern includes a peak intensity and said percentage of said emitted light includes light emitted in substantially all of the directions of said directional spatial radiation pattern along which the emitted intensity exceeds fifty percent of said peak intensity.

26. A high efficiency lighting device as in any one of claims 1–10 wherein;

for each said light source said directional spatial radiation pattern includes a peak intensity and said percentage of said emitted light includes light emitted in substantially all of the directions of said directional spatial radiation pattern along which the emitted intensity exceeds thirty percent of said peak intensity.

27. A high efficiency lighting device as in any one of claims 1–9 wherein;

said concave surface of revolution further includes a vertex, said first reflective zone does not include said vertex, and;

said second reflective zone does not include said vertex.

28. A high efficiency lighting device as in any one of claims 1–10 wherein;

each said reflective zone is at a different location on said primary mirrored reflector.

* * * * *